United States Patent [19]

Kawaguchi et al.

[11] Patent Number: 4,485,592

[45] Date of Patent: Dec. 4, 1984

[54] MACHINE FOR SUPERFINISHING ANNULAR WORKPIECES

[75] Inventors: Kizo Kawaguchi; Teruo Matsuda, both of Toyonaka, Japan

[73] Assignee: Osaka Seiki Kabushiki Kaisha, Osaka, Japan

[21] Appl. No.: 416,707

[22] Filed: Sep. 10, 1982

[30] Foreign Application Priority Data

Dec. 23, 1981 [JP] Japan ..... 56-213507

[51] Int. Cl.[3] ..... B24B 9/00

[52] U.S. Cl. ..... 51/58; 51/166 MH

[58] Field of Search ..... 51/58, 57, 291, 347–349, 51/33 W, 166 TS, 166 MH, 166 FB, 166 T

[56] References Cited

U.S. PATENT DOCUMENTS

| | | | |
|---|---|---|---|
| 2,350,527 | 6/1944 | Peden | 51/347 |
| 2,634,561 | 4/1953 | Wayne | 51/58 |
| 3,339,312 | 9/1967 | Hannon | 51/58 |
| 3,503,154 | 3/1970 | Schmidt | 51/58 |

*Primary Examiner*—Frederick R. Schmidt
*Assistant Examiner*—Matthew Daschel
*Attorney, Agent, or Firm*—Wenderoth, Lind & Ponack

[57] ABSTRACT

A machine for superfinishing annular workpieces such as bearings, including a mechanism for rotating the annular workpiece about a first axis of rotation, a holder for retaining in fixed relative positions a plurality of holding stones, and a mechanism for moving the holder to selectively bring any one of the honing stones into contact with the outer surface of the annular workpiece being superfinished.

14 Claims, 10 Drawing Figures

MACHINE FOR SUPERFINISHING ANNULAR WORKPIECES

BACKGROUND OF THE INVENTION

1. Field of the Invention

The present invention relates to a superfinishing machine for producing annular objects such as bearings.

2. Description of the Prior Art

Conventional superfinishing machines for producing annular objects are equipped with one honing stone and one shaft or finishing shaft. Therefore, several kinds of finishing machines are required for rough finishing and fine finishing of an annular workpiece using different kinds of honing stones. According to this conventional manner or producing annular objects, the annular workpiece must be transferred from the roughfinishing machine to the fine-finishing machine upon completion of rough finishing. However, during this transfer, the workpiece may be located out of position or alignment, thereby affecting accuracy in finishing. Such mis-location and mis-alignment have become serious problems since very great finishing accuracy has been required for some objects. For example, an accuracy of 1/100,000 mm has been demanded recently for some bearings.

OBJECTS AND SUMMARY OF THE INVENTION

A primary object of the present invention is to provide a useful superfinishing machine for finishing annular workpieces, which is capable of performing both rough finishing and superfinishing without transfer of the workpiece from one machine to another.

Another object of the present invention is to drastically reduce the required frequency of changes of honing stones by mounting in the machine two or more honing stones of the same kind.

To accomplish these objects, a machine according to the present invention includes a mechanism to rotate the annular workpiece, a plurality of honing stones for superfinishing the outer surface of the annular workpiece, a holder for retaining the honing stones, and a mechanism which selectively brings any one of these honing stones into contact with the outer surface of the annular workpiece.

BRIEF DESCRIPTION OF THE DRAWINGS

These and other features and objects of the invention will be best understood from the following detailed description of the preferred embodiment taken with the accompanying drawings in which.

DETAILED DESCRIPTION OF THE PREFERRED EMBODIMENTS

Figure 1:
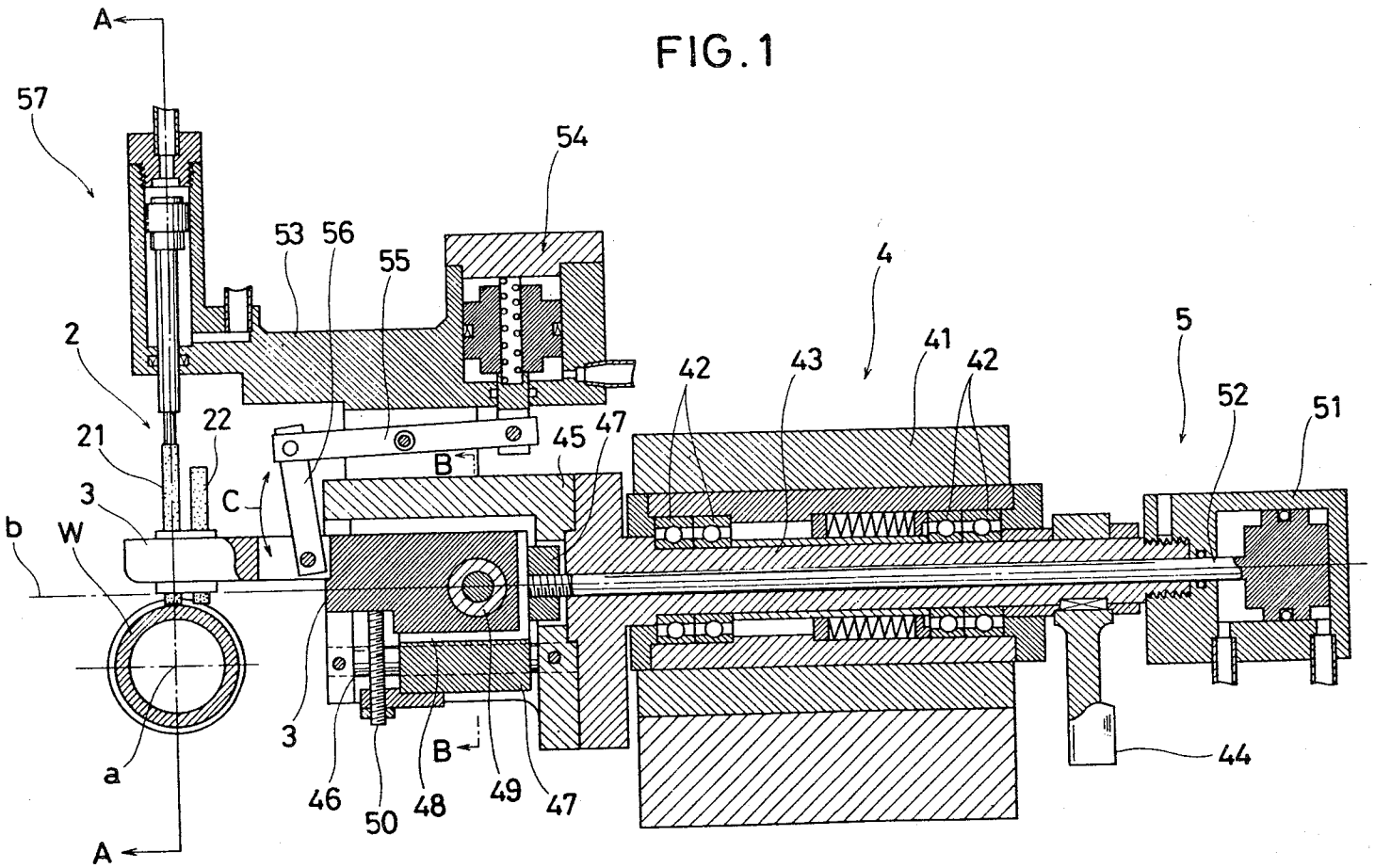
FIG. 1 is a front sectional view of a superfinishing machine for an annular workpiece in accordance with one embodiment of the present invention.
Figure 2:
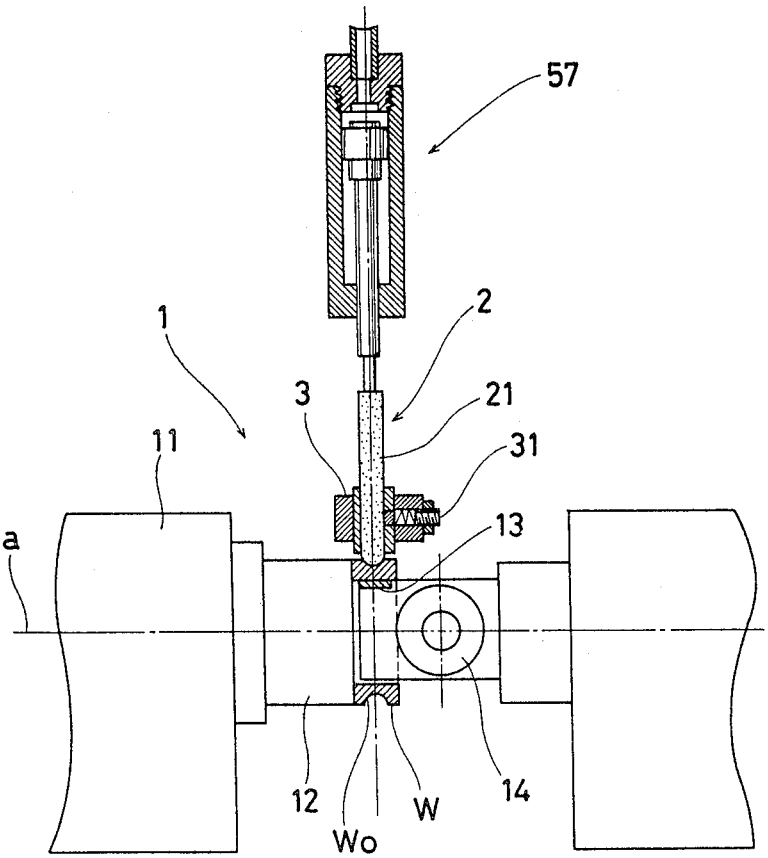
FIG. 2 is a view thereof taken along line A—A in FIG. 1.

FIG. 1 is a front elevation of a finishing machine for superfinishing the outer surface of an annular workpiece W with an oscillating honing stone and FIG. 2 is a sectional view thereof taken along the line A—A in FIG. 1. In the embodiment shown, the surface being finished Wo is a raceway surface of the inner ring of a bearing. As shown in FIG. 2, the machine includes a mechanism for rotating the annular workpiece W, including a driving unit 11, a packing plate 12 secured to the tip of the main shaft of the driving unit, a shoe 13 for supporting the annular workpiece W from the inner side thereof so as to align it with the axial line a of the main shaft, and a pressure roller 14 for pressing the workpiece W toward the backing plate 12.

In the embodiment shown in FIG. 1 and FIG. 2, two honing stones 2 including stones 21 and 22, are used to superfinish the outer surface Wo of the annular workpiece W, though more individual stones may be used. These honing stones 2 can be different from each other in kind. For example, stone 21 can be suitable for rough finishing and stone 22 can be suitable for fine finishing. Alternatively, the two stones can be of the same kind. By mounting in the machine honing stones which are different in kind, superfinishing of a super-accuracy can be performed in a short period of time, whereas the frequency of changes of honing stones in the machine can be significantly reduced by mounting in the machine stones of the same kind.

The honing stones 2 are retained in the holder 3 with springs 31 which press respective sides of the honing stones 2. As shown in FIG. 1, the holder 3 is connected to a mechanism 4 for oscillating the honing stones 2.

Figure 5:
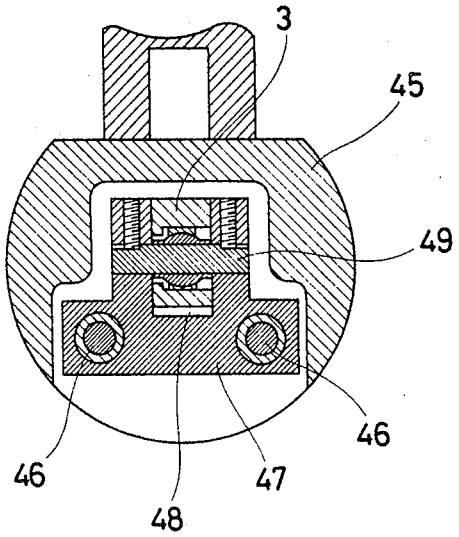
FIG. 5 is a sectional view taken along line B—B in FIG. 1.

Mechanism 4 includes a base 41, and a horizontal longitudinally extending cylindrical shaft 43 rotatably supported by bearings 42 provided in base 41, an arm 44 for oscillating the cylindrical shaft 43, and a holder unit 45 fixed to one end of the cylindrical shaft 43. The holder unit 45, as shown in the sectional view of FIG. 5, is partly cut out at the internal lower part thereof, and two parallel horizontal sliding bars 46 are provided within the cut out part. Bars 46 are parallel with the horizontal axis b of cylindrical shaft 43. A sliding member 47, slidably mounted on bars 46, has a groove 48 extending in parallel with the sliding bars 46, and a pin 49 which extends horizontally across groove 48 in a direction perpendicular to the sliding bars 46.

Holder 3 is pivotally supported by pin 49 and rotatable in both upward and downward directions c, downward rotation of the holder 3, however, being limited by a vertically adjustable stopper 50 provided upright on the holder unit 45. Thus, holder 3 is coupled to the holder unit 45 through the sliding member 47 as shown in FIG. 1 and FIG. 5 so that any one of honing stones 2 can be selectively brought into contact with the outer surface Wo of the annular workpiece W. A mechanism for selecting one of honing stones 2 is described below.

Figure 3:
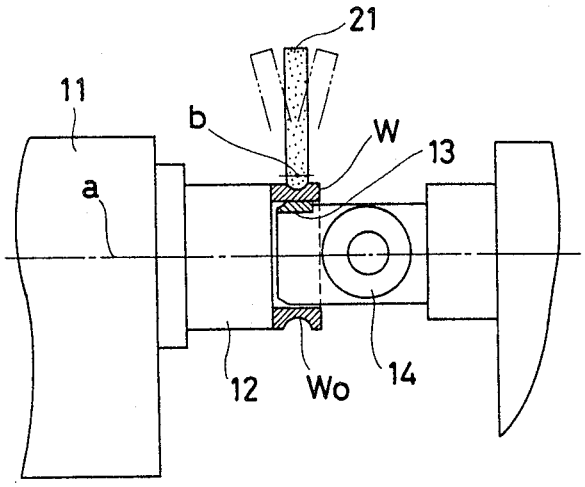
FIG. 3 is a view showing the oscillation of a honing stone at one radius of oscillation.
Figure 4:
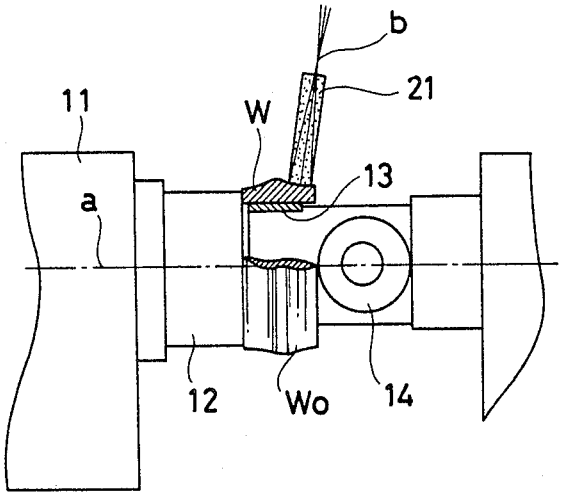
FIG. 4 is a view showing the oscillation of a honing stone at another radius of oscillation.

On the axis b of cylindrical shaft 43, which is perpendicular to the main axis a, honing stones 2, in this case honing stones 21 and 22, are lined up. The positional relationship between the cylindrical shaft axis b and honing stones 21 and 22 may be adjusted. One such relationship is shown in FIG. 3. In operation, honing stones 21 and 22 are oscillated around axis b with oscillation of the cylindrical shaft 43, as shown in fantom lines in FIG. 3, and the outer surface Wo of the annular workpiece W is rotated in contact with with one of honing stones 21 and 22 so that the workpiece is superfinished in the form of an accurately ground groove. Since the positional relationship between cylindrical shaft axis b and the honing stones 21 and 22 may be changed, the outer surface Wo of the annular workpiece W can, for example, also be superfinished as shown in FIG. 4.

Figure 6A:
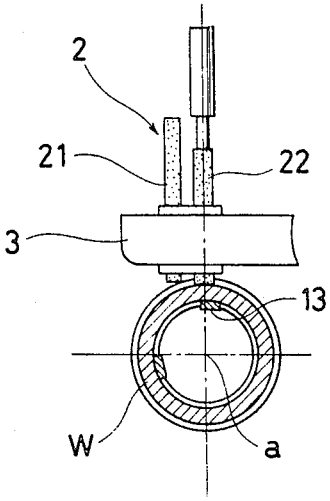
FIG. 6(*a*) and FIG. 6(*b*) are views respectively showing the superfinishing operation of one honing stone and of the other.
Figure 6B:
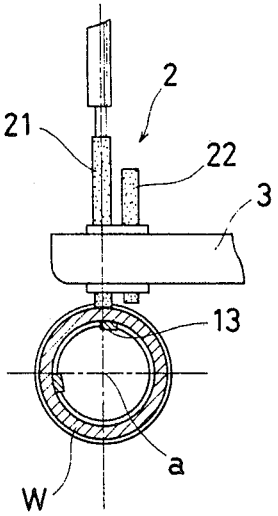

A mechanism 5 for selectively bringing either of honing stones 21 and 22 into contact with the outer surface Wo of the annular workpiece W is shown in FIG. 1 to include a hydraulic index cylinder 51 fixed to the end of the cylindrical shaft 43 furthest from holder 3, and a rod (inner shaft) 52 slidably inserted through cylindrical shaft 43 longitudinally thereof. The tip of rod 52 closest to holder 3 is connected to sliding member 47. The stroke of index cylinder 51 is made equal to a spacing between honing stones 21 and 22. Therefore, to-and-fro movement of the index cylinder 51 enables either of honing stones 21 and 22 to be selectively brought into contact with the outer surface Wo of the annular workpiece W, as shown in FIG. 6(*a*) and FIG. 6(*b*). When rather than having only two honing stones 21 and 22, the number of honing stones 2 is large, selective engagement of individual honing stones with the workpiece W is obtained by employing a long-stroke cylinder and by intermittently moving the holder 3 a distance equal to the spacing between the honing stones while controlling the quantity of oil fed to the cylinder 51.

When index cylinder 51 is operated to selectively bring one of honing stones 21 and 22 into contact with the outer surface Wo of the annular workpiece W, honing stones 21 and 22 slide on the outer surface Wo of the annular workpiece W and are capable of scratching its surface. To prevent such scratching, in the embodiment shown, a block 53 provided with a single-acting hydraulic cylinder 54 for lifting the holder 3, is mounted on the holder unit 45 as is illustrated in FIG. 1. Cylinder 54 and holder 3 are pivotally connected with each other through mutually pivotally connected connecting rods 55 and 56. Cylinder 54 is also connected to index cylinder 51 by means of an oil carrying pipe so that cylinder 54 acts synchronously with cylinder 51. An oil pressure responsive piston-like pressing member 57 capable of exerting pressure of an appropriate intensity to whichever honing stone 21 or 22 is being brought into contact with the outer surface Wo of the annular workpiece W is also provided on block 53. In operation, pressing member 57 is deactivated synchronously with the operation of the index cylinder 51.

Figure 7:
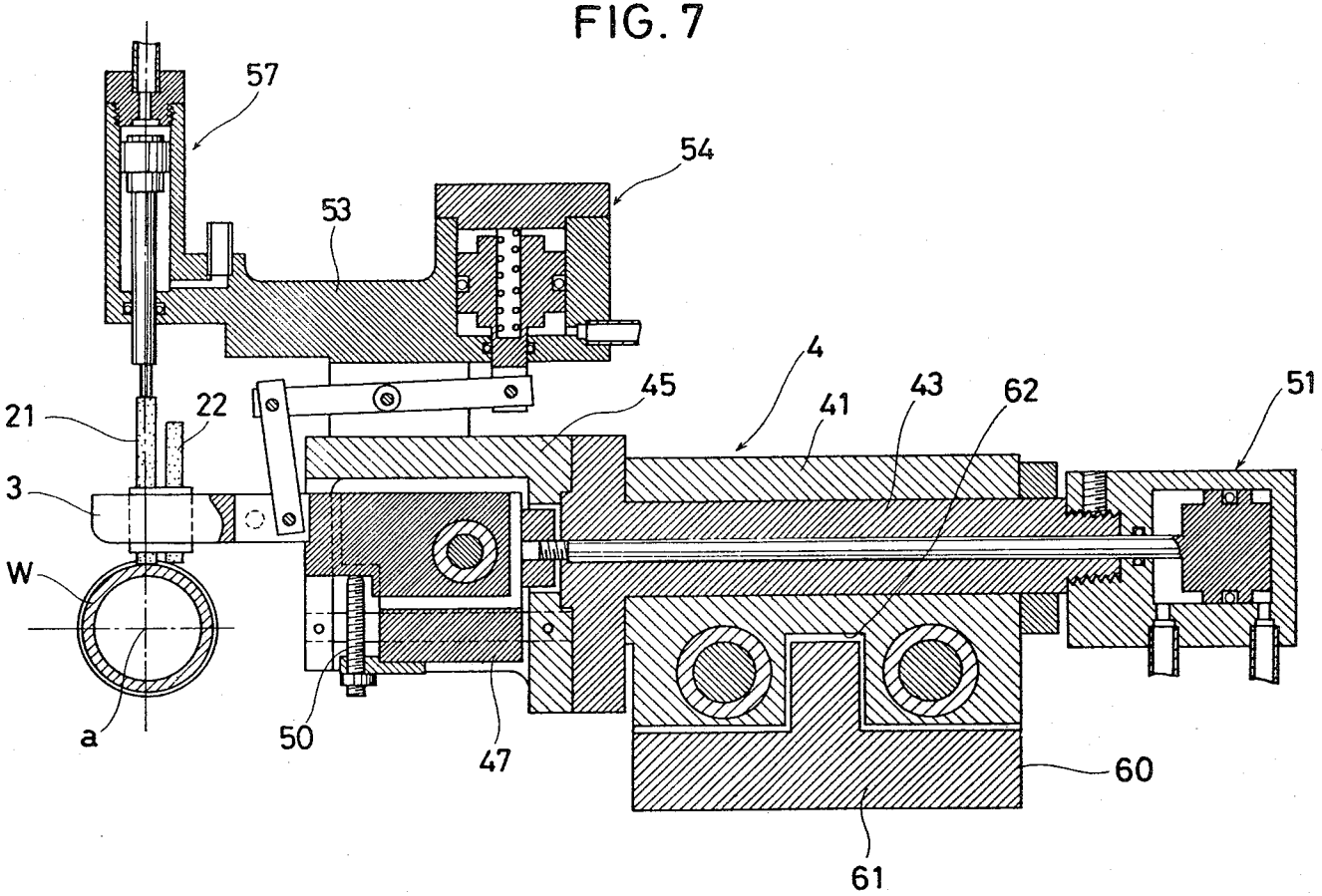
FIG. 7 is front sectional view of another embodiment of the present invention.
Figure 9:
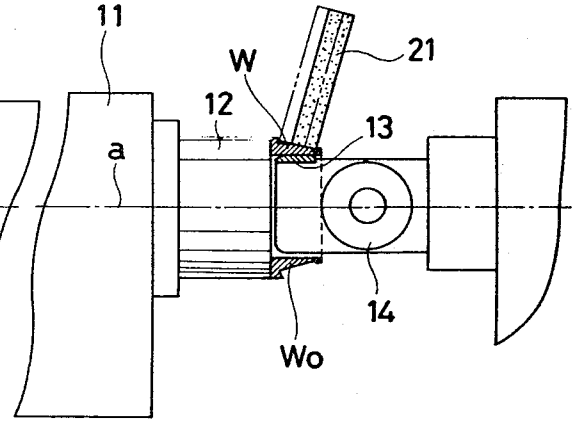
FIG. 9 is a view showing a second mode of finishing an annular workpiece with the machine shown in FIG. 7.
Figure 8:
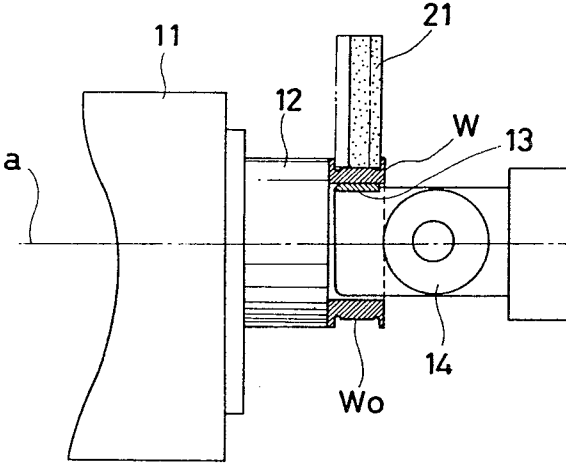
FIG. 8 is a view showing a first mode of finishing an annular workpiece with the machine shown in FIG. 7.
Figure 10:
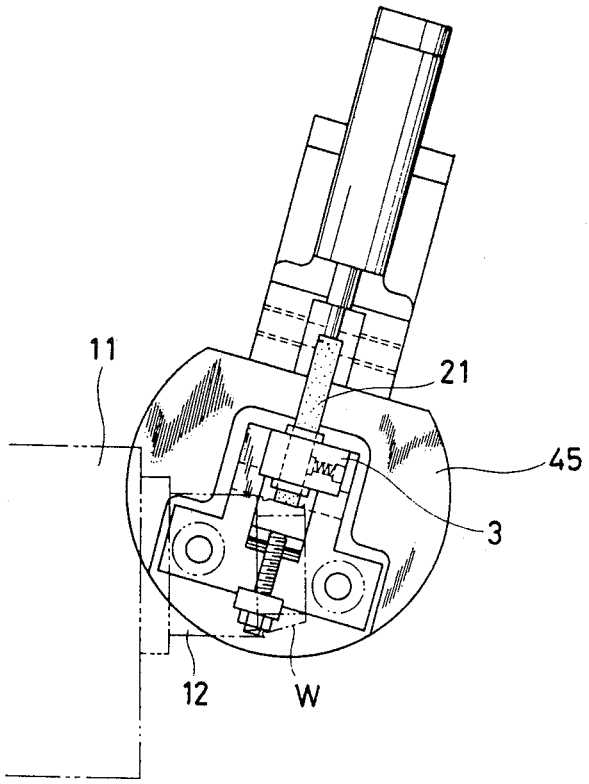
FIG. 10 is a view showing a main part of the machine shown in FIG. 7 inclined for performing the operation shown in FIG. 9.

In FIG. 7 is shown a second embodiment of the invention which performs superfinishing of the outer surface Wo of the annular workpiece W by simple harmonic motion of honing stones 21 and 22, rather than by rotation thereof about its longitudinal axis. In this machine, the cylindrical shaft 43 is fixed to the base 41 and, accordingly, is incapable of oscillating. Instead, the base 41 is mounted on stationary table 60 for oscillatory horizontal movement perpendicular to the longitudinal direction of shaft 43. The direction of oscillatory movement is primarily determined by engagement of a protrusive rail 61 formed on the top of the stationary table 60 with a rail-receiving groove 62 formed on the underside of the base 41. As a result, the outer surface Wo of the annular workpiece W can be superfinished to be flat, in the form of a cylindrical ring as shown in FIG. 8. By inclining stationary table 60, the moving direction of the honing stones 21 and 22 can be changed, whereby the outer surface Wo of the annular workpiece W can be superfinished, for example, in the shape of a hollow frustum of a cone as shown in FIG. 9. Holder unit 45 is shown in an inclined position in FIG. 10.

As described above, according to the invention, different grades of superfinishing such as rough finishing and fine finishing can be performed by a single unit without transferring the workpiece since different kinds of honing stones can be retained by the same holder. Consequently, the annular workpiece is never located out of position or alignment, thereby permitting very accurate superfinishing in a short period of time. On the other hand, if honing stones of the same kind are retained by the holder, even when one honing stone is damaged, the other one can be selectively used to superfinish the workpiece, whereby the frequency of change of honing stones can be reduced to a level which is in inverse proportion to the number of honing stones retained by the holder at one time.

While only two preferred embodiments of the present invention have been disclosed, it is to be understood that the invention is described by way of examples only, and not in a limiting sense, and the scope of the present invention is determined by the following claims.

What is claimed is:

1. A machine for superfinishing an annular workpiece having a radially outwardly facing outer surface, comprising:

a. means for rotating the annular workpiece about a first axis of rotation;

b. a holder having means for holding a plurality of honing stones in alignment along a second axis perpendicular said first axis in mutually fixed spacial relationship to each other;

c. means, coupled to said holder, for selectively bringing any one of said plurality of honing stones into contact with the outer surface of the annular workpiece; said bringing means including:

(1) a slide unit including an inner shaft extending longitudinally, parallel said second axis, having a first end and a second end, fixed adjacent said second end to said holder and movable longitudinally, parallel said second axis, and (2) means, fixed to said inner shaft, for driving said inner shaft longitudinally so as to move said holder and the plurality of honing stones along said second axis;

d. a holder unit, slidably supporting said slide unit for longitudinal movement relative thereto; and e. means for oscillating said holder unit in a direction perpendicular said second axis, said holder unit engaging said slide unit so as to oscillate said holder when said holder unit is oscillated by said oscillating means.

2. A machine as in claim 1, wherein said slide unit includes a slide member fixed to said second end of said inner shaft, said slide member having means for pivotally supporting said holder for pivotal movement about a fourth axis parallel said first axis, said holder unit having means for slidably supporting said slide member for movement parallel said second axis, said slide member slidably supporting means engaging said slide member so as to oscillate said slide member and said holder when said holder unit is oscillated by said oscillating means.

3. A machine as in claim 2, further comprising means for reciprocally pivoting said holder about said fourth axis.

4. A machine as in claim 3, wherein said reciprocally pivoting means comprises a drive structure, means for rigidly connecting said drive structure to said holding unit, and at least one pivotal member pivotally connecting said drive structure and said holder, said drive structure comprising means for reciprocally driving said at least one pivotal member to reciprocally pivot said holder about said fourth axis.

5. A machine as in claim 1, wherein said oscillating means comprises means for moving said holder parallel said first axis.

6. A machine as in claim 5, wherein said means for moving said holder parallel said first axis comprises a first member slidably receiving said inner shaft and coupled at an end thereof to said holder, and means for slidably supporting said first member for movement parallel said first axis.

7. A machine as in claim 1, further comprising means for pressing one of said plurality of honing stones held in said holder in alignment with said pressing means against said workpiece with a force directed along a third axis generally perpendicular said first and second axes.

8. A machine as in claim 1, wherein said oscillating means comprises means, surrounding said inner shaft, for reciprocally pivoting said holder about said second axis to angularly oscillate said honing stones.

9. A machine as in claim 8, wherein said base has a cylindrical opening, said holding unit comprising a cylindrical shaft surrounding said inner shaft, said oscillating means further comprising bearings disposed in said cylindrical opening for rotatably supporting said cylindrical shaft in said cylindrical opening.

10. A machine as in claim 1, wherein said driving means comprises a cylinder fixed to said holder unit, and a piston longitudinally movable within said cylinder fixed to said first end of said inner shaft.

11. A machine as in claim 1, wherein said oscillating means comprises a base, said holder unit being pivotally supported by said base, and a pivot arm fixed to said holder unit for pivoting said holder unit about said second axis.

12. A machine as in claim 1, further comprising a pressing member fixed to said holder unit for oscillation therewith in alignment with said workpiece rotating means for pressing radially inward with respect to said second axis on one of the honing stones to press the honing stone against the outer surface of the workpiece.

13. A machine for superfinishing an annular workpiece, having a radially outwardly facing outer surface, comprising:

means for rotating the annular workpiece about a first axis of rotation;

means for retaining a plurality of honing stones, said retaining means comprising means for holding said plurality of honing stones in fixed spacial relationship relative thereto, said holding means comprising a holder for holding said plurality of honing stones in alignment along a second axis perpendicular said first axis;

means, coupled to said retaining means, for selectively bring any one of said honing stones into contact with the outer surface of the annular workpiece, said honing stones bringing means comprising means for moving said holder along said second axis, said holder moving means comprising an inner shaft having a first end and a second end, fixed at said second end to said holder and movable parallel said second axis, and drive means, fixed to said inner shaft, for driving said shaft and said holder along said second axis; and means for reciprocating said holder in a direction continuously parallel said first axis to reciprocate said honing stones.

14. A machine as in claim 13, wherein said means for moving said holder parallel said first axis comprises a receiving member slidably receiving said inner shaft for movement along an axis which is parallel said second axis and coupled at an end thereof to said holder, and means for slidably supporting said receiving member for movement along an axis which is parallel said first axis.

* * * * *